US006065159A

United States Patent [19]

Hirsh

[11] Patent Number: 6,065,159

[45] Date of Patent: May 23, 2000

[54] PROTECTIVE HELMET FOR ACTIVE USE BY A WEARER IN A SPORTS ACTIVITY

[75] Inventor: Donald W. Hirsh, Beltsville, Md.

[73] Assignee: United Sports Gear, Inc., Laurel, Md.

[21] Appl. No.: 09/084,996

[22] Filed: May 28, 1998

[51] Int. Cl.[7] ..... A42B 3/00

[52] U.S. Cl. ..... 2/425; 2/413; 2/414

[58] Field of Search ..... 2/410, 411, 413, 2/414, 425, 417, 418

[56] References Cited

U.S. PATENT DOCUMENTS

| | | | |
|---|---|---|---|
| D. 366,348 | 1/1996 | Boone . | |
| 1,539,558 | 5/1925 | Goldsmith | 2/414 |
| 1,842,953 | 1/1932 | Turner | 2/414 |
| 1,907,709 | 5/1933 | Barrow . | |
| 3,315,273 | 4/1967 | Bullard | 2/410 |
| 3,627,322 | 12/1971 | Leonhart . | |
| 4,279,037 | 7/1981 | Morgan . | |
| 4,698,852 | 10/1987 | Romero . | |
| 4,947,488 | 8/1990 | Ashinoff | 2/411 |
| 5,226,180 | 7/1993 | Leach | 2/411 |
| 5,263,203 | 11/1993 | Kraemer et al. | 2/413 |
| 5,544,367 | 8/1996 | March, II | 2/410 |
| 5,882,205 | 3/1999 | Peterson | 2/425 |

FOREIGN PATENT DOCUMENTS 2390116 12/1978 France .

*Primary Examiner*—Michael A. Neas
*Attorney, Agent, or Firm*—Dinesh Agarwal, P.C.

[57] ABSTRACT

A protective helmet for active use by a player in a sports activity, such as soccer, includes a shell made of a soft material and which has the general configuration to fit a wearer's head. A device for stabilizing the shell on the wearer's head, such as a chin-strap, is operably connected to the shell. The shell includes a member for allowing a player to actively deflect a ball during a play. The shell further includes a member for dampening the force of impact by the ball over a head region of the wearer.

20 Claims, 7 Drawing Sheets

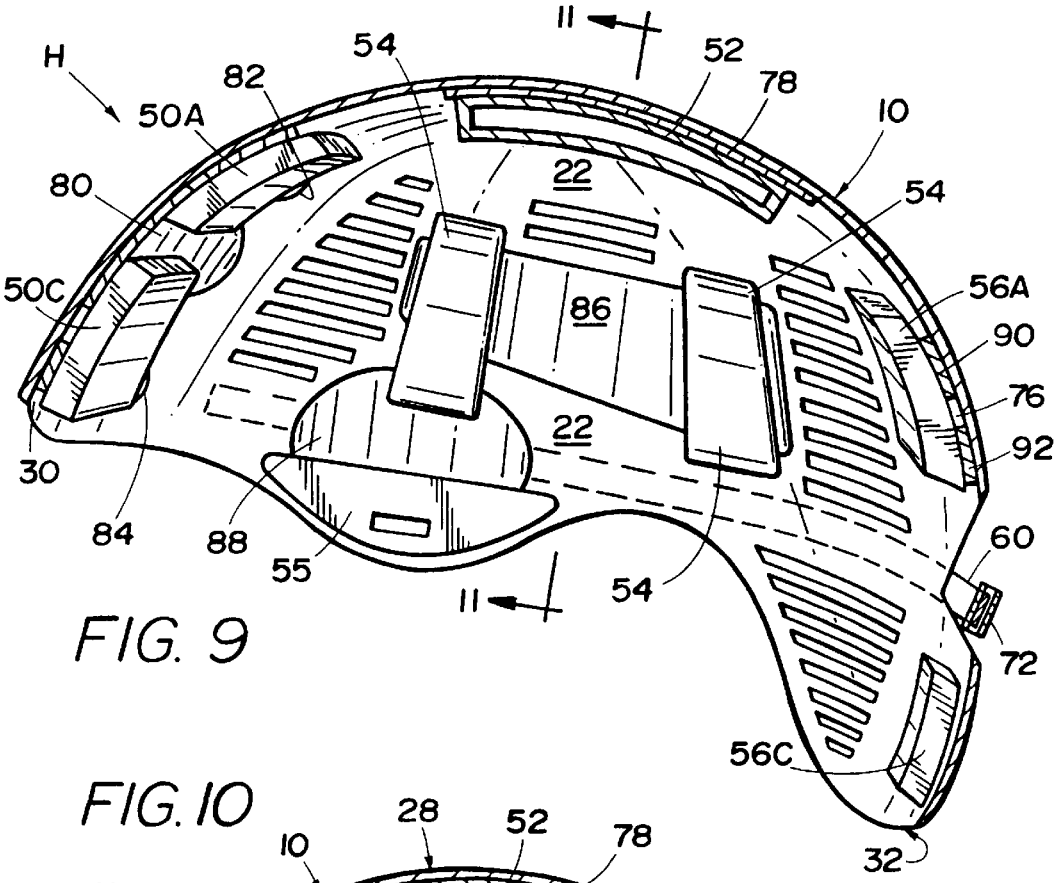
FIG. 9
FIG. 10
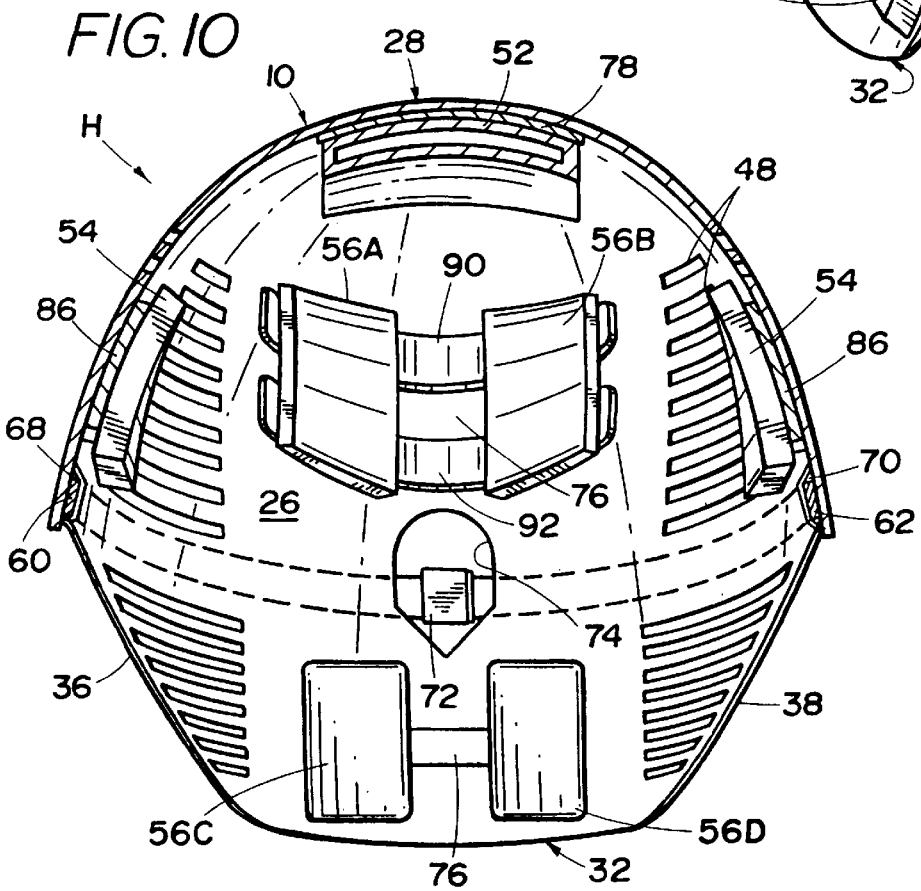

PROTECTIVE HELMET FOR ACTIVE USE BY A WEARER IN A SPORTS ACTIVITY

FIELD AND HISTORICAL BACKGROUND OF THE INVENTION

The present invention is directed to protective helmets or head guards, and more particularly to a protective helmet for active use by a player in a sports activity, such as soccer and the like.

Various head guards, helmets and the like are currently available for use in different sports activities. In this regard, helmets for bicycling, rollerblading, skateboarding, baseball, football, hockey, etc., are now considered standard essential equipment for use by players. In fact, many municipalities now require helmets for many of these and other sports activities. The overwhelming concern for requiring the use of a protective helmet or head guard is, of course, the protection of a player's head in an effort to prevent head injuries which, in some instances, could prove to be fatal, if a proper head guard or helmet is not worn by the player.

Generally, the design and construction of a particular helmet is dictated by the nature of the activity and the level of aggressiveness typically used by the players in that activity. Accordingly, a variety of helmet designs have been proposed in the art for use in different activities; and, since most sports do not allow the active use of a head gear, the overriding concern in the design and construction of helmets is the player's head injuries.

The game of soccer, however, is different in that soccer players use the headgear or helmet actively to pass or deflect a ball, a technique commonly referred to as "heading" the ball. In heading the ball, soccer players often use their foreheads. Although the soccer players are permitted to use their heads in heading the ball, the players generally do not wear any type of protective helmet. In this connection, numerous medical studies have shown that head injuries are quite prevalent in soccer, and have further demonstrated two primary concerns. First, head-to-head, head-to-ground, or head-to-goalpost impacts may produce acute head injuries, such as concussions. In fact, recent studies have shown that second or third head injuries within a day or so, may produce serious injury, disability or even death, specially in pediatric cases. Second, repeated heading of the ball has been shown to cause micro-traumas, which accumulate over time. These injuries may also lead to brain atrophy and have been shown to lower the IQ of a player who frequently heads a ball.

The use of a protective helmet, such as those commonly used in, for example, bicycling, football, or boxing, would be an obvious choice to protect soccer players from suffering head injuries as a result of heading, or those injuries which normally occur during a play. The benefits provided by the helmets used in various other activities may arguably provide similar benefits to a soccer player. However, there are unique challenges associated with the design and construction of a soccer headgear, particularly in view of the permitted heading technique. For instance, a hard helmet, such as the one used in bicycling or football, would give the player an unfair advantage while heading the ball, in that the ball would bounce-off the helmet with too great a velocity. Moreover, these types of helmets are extremely hard and could hurt another player not wearing a similar type of protective headgear. Soft helmets, such as those used in boxing, would give the player a competitive disadvantage in that the ball would not bounce-off the head with sufficient velocity. In other words, a protective helmet for soccer must be hard enough to bounce-off a soccer ball with sufficient velocity on the one hand, and protect the players from suffering other game-related injuries, on the other hand.

Various examples of head guards are disclosed in U.S. Pat. Nos. 1,907,709; 3,627,322; 4,279,037; 4,698,852; 4,947,488; Des. 366,348; and French 2,390,116. These head guards do not, however, provide protection to the overall head region of a player while allowing heading of a ball during a play.

OBJECTS AND SUMMARY OF THE INVENTION

The principal object of the present invention is to provide a protective helmet for active use by a player in a sports activity, such as soccer.

Another object of the present invention is to provide a protective helmet for active use by a soccer player, which allows the player to head a ball, and further provides protection to the overall head of the player.

Yet another object of the present invention is to provide a protective helmet for active use by a soccer player which provides protection against injuries on other parts of a player's body, such as shoulders.

An additional object of the present invention is to provide a protective helmet for active use by a player which dampens the force of impact and weakens concussion waves encountered as a result of heading or contacting the ball with the head region by a player.

Yet an additional object of the present invention is to provide a protective helmet for active use by a player which dissipates the impact energy throughout the helmet thereby dampening the effects of a concussive wave.

Still yet an additional object of the present invention is to provide a protective helmet for use by a player in a sports activity, which is light-weight, less bulky, provides ventilation, and is comfortable to wear.

A further object of the present invention is to provide a protective helmet for use by a player in a sports activity which requires minimal maintenance and is durable.

In summary, the present invention provides a protective helmet for use by a player in a sports activity, and particularly for active use by a soccer player, which allows the player to head-off a ball while providing protection to the overall head region of the player. The protective helmet of the present invention therefore allows a player, and particularly a soccer player, to fully participate in the game while preventing head injuries, such as concussions. The protective helmet of the present invention is further light-weight, less bulky, provides excellent ventilation and is therefore very comfortable to wear.

BRIEF DESCRIPTION OF THE DRAWINGS

The above and other objects, novel features, and advantages of the present invention will become apparent from a review of the detailed description of the invention provided below and as shown in the drawings, in which;

FIG. 9 is a view similar to FIG. 4 showing a second alternative embodiment of the protective helmet of the present invention;

FIG. 10 is a view similar to FIG. 5 showing the second alternative embodiment of the protective helmet of the present invention;

DETAILED DESCRIPTION OF THE INVENTION

Figure 1:
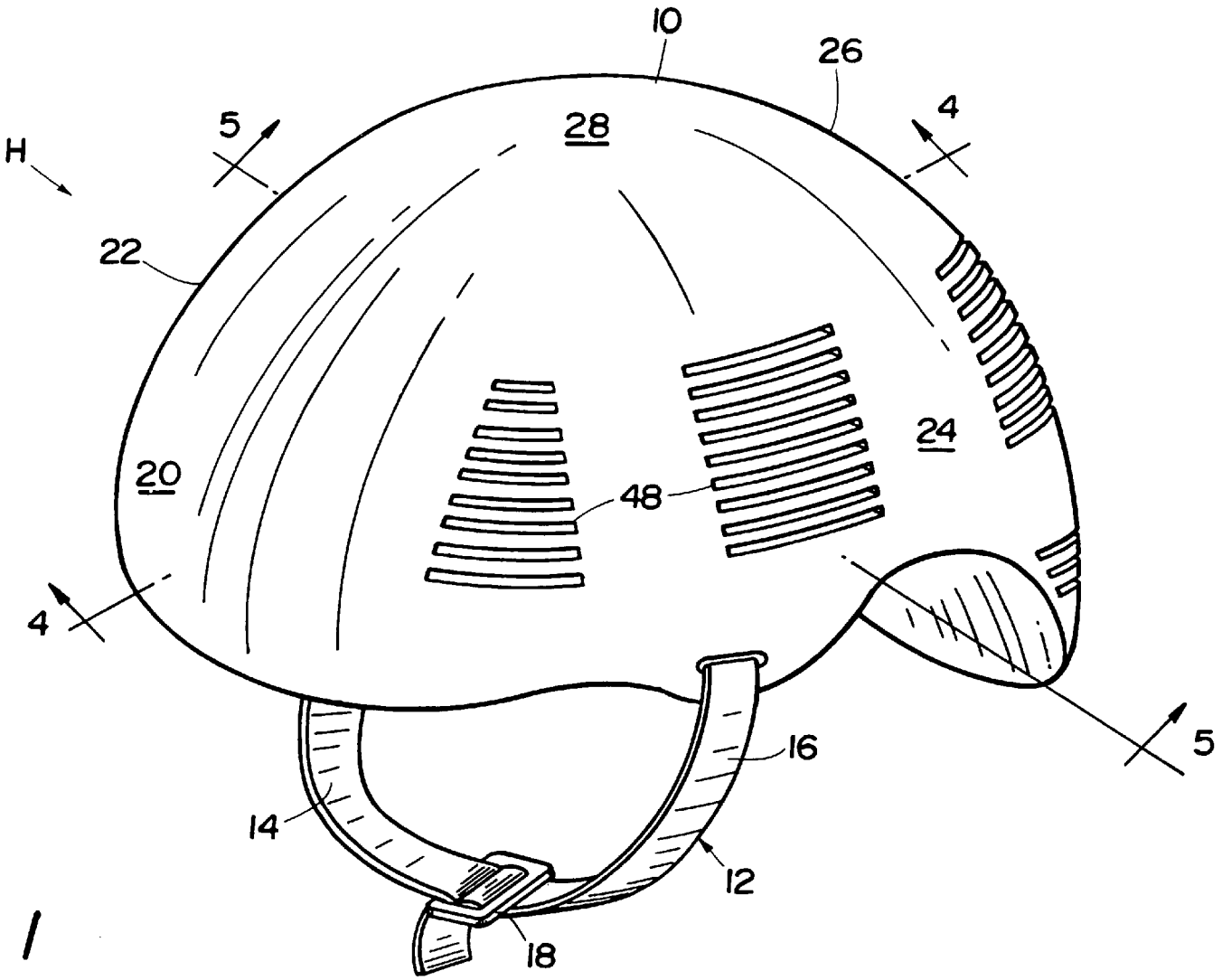
FIG. 1 is a right perspective view of a protective helmet of the present invention.

As best shown in FIG. 1, the protective helmet H of the present invention is in the shape of a shell 10 which has the general configuration to fit a person's head. The shell 10 is preferably made of a soft nylon or the like material and includes a chinstrap 12 to stabilize the helmet H on a person. The strap 12 is a conventional strap with left and right sections 14 and 16 that can be joined together by a conventional buckle or the like mechanism 18.

The shell 10 includes a front region 20, left region 22, right region 24, rear region 26 and top region 28. As can be readily appreciated from FIG. 2, the rear region 26 is longer in length than the front region 20. The front region 20 is shaped and configured to generally overlie a person's forehead and accordingly includes a front edge 30 which is slightly curved on the outer ends to generally follow the contour directly above a person's eyes. In the like manner, the rear edge 32 of rear region 26 generally follows the contour of a person's rear neck region. In particular, rear edge 32 includes a generally horizontal lower edge 34, and left and right, upwardly and outwardly inclined edges 36 and 38.

Figure 2:
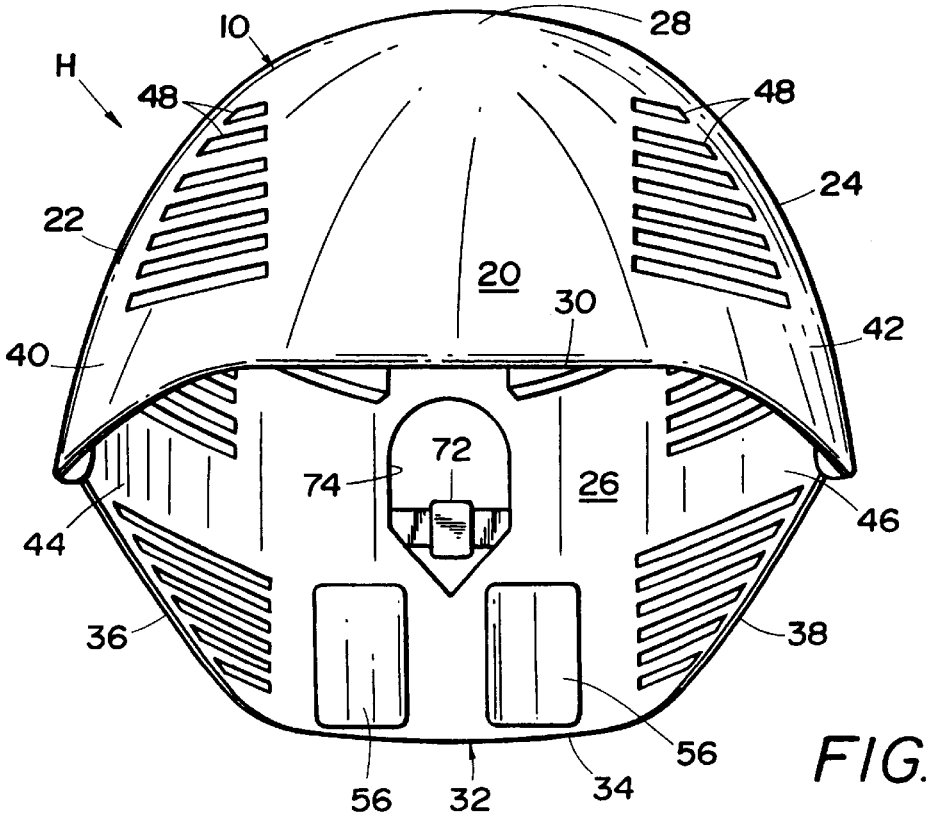
FIG. 2 is a front elevational view of the protective helmet of the present invention.

As best shown in FIG. 2, the front region 20 includes left and right side subregions 40 and 42, which flare outwardly, and extend towards the rear to meet corresponding left and right regions 22 and 24, respectively. In the like manner, the rear region 26 also includes left and right subregions 44 and 46 which flare outwardly and extend towards the front to meet the corresponding left and right regions 22 and 24. The left and right subregions 40 and 42 are configured to correspond to the side of a person's head, and left and right rear subregions 44 and 46 are configured to follow the contour of the rear neck portion of a person.

As best shown in FIGS. 1–4, left and right front subregions 40 and 42, left and right rear subregions 44 and 46, and left and right regions 22 and 24, are provided with horizontally extending and vertically spaced generally rectangular vent holes 48. (It should be noted herewith that it is well within the scope of the invention to vary the arrangement, configuration, and the total number of vent holes, as needed.)

Figure 6:
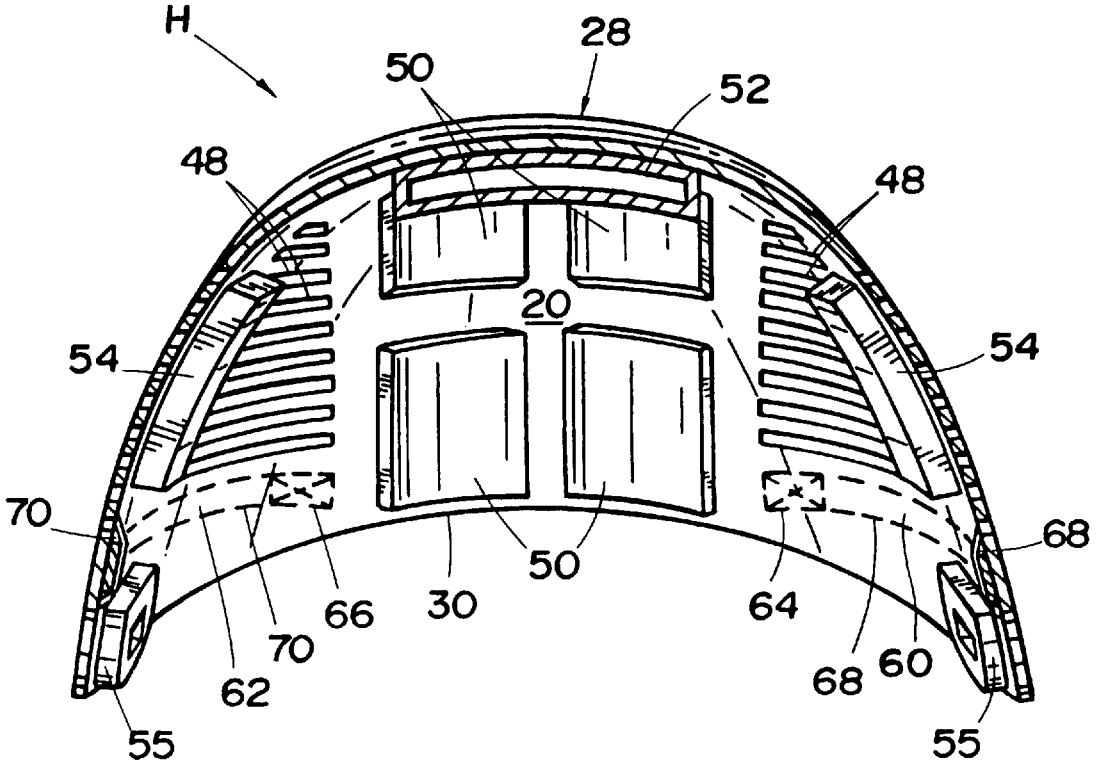
FIG. 6 is a vertical sectional view taken along line 6—6 of FIG. 4.

In order to provide sufficient resiliency in the front region 20 to allow a player to deflect or head-off a ball, preferably four resilient cushions 50 are detachably provided on the inside of the front region 20 (FIG. 6). Although not shown, Velcro (hook and loop fastener) or other conventional fasteners may be used to attach cushions 50 to the shell 10. Preferably, the cushions 50 are pre-inflated with a fluid, such as air, gel, etc., or could be made of a foam material, and further may be made of a sweat absorbing material.

As best shown in FIG. 6, the four cushions 50 are arranged in a generally square format and are vertically and horizontally spaced from each other. (Although, four individuals cushions are shown in the drawings, it is within the scope of the invention to vary the total number and configuration, including dimensions, as desired). These cushions are selected so as to impart the front region 20 with a hardness substantially corresponding to the hardness of a person's forehead.

Figure 4:
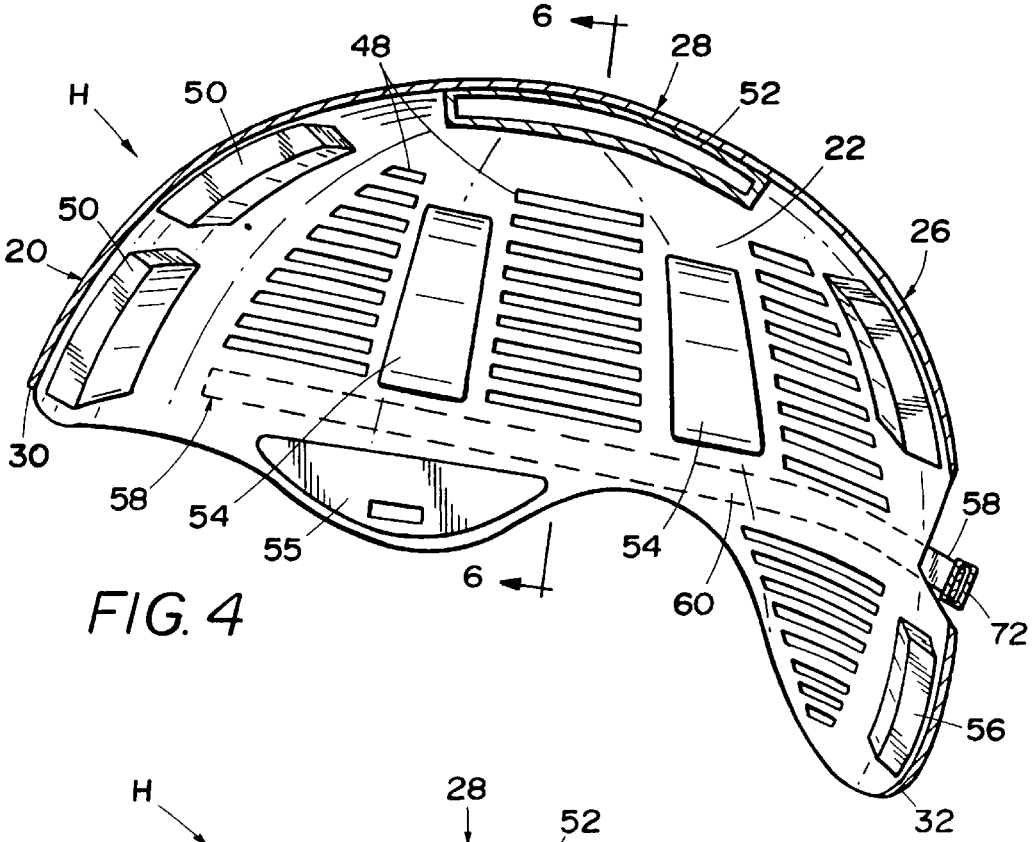
FIG. 4 is a vertical sectional view taken along line 4—4 of FIG. 1.
Figure 5:
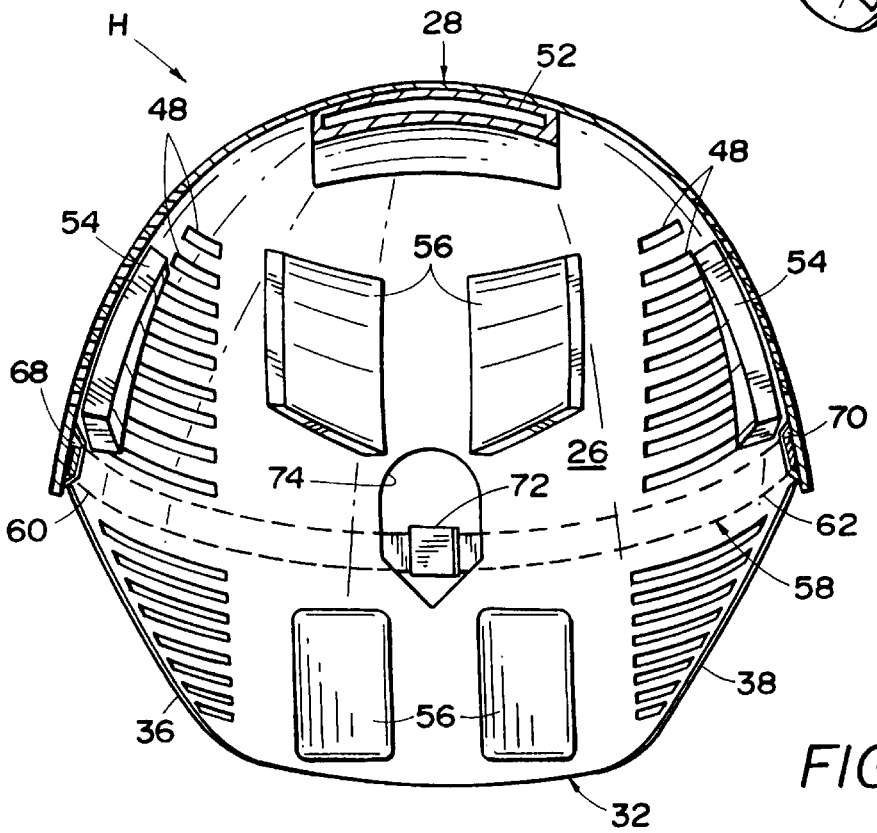
FIG. 5 is a vertical sectional view taken along line 5—5 of FIG. 1.

In order to protect a person from suffering head injuries and to dampen the energy of impact from the ball, various other pads or cushions are provided inside top and rear, and left and right regions of the shell. In particular, a cushion 52 is provided on the inside of the top region 28 and extends between the front and rear regions 20 and 26 of the shell 10 (FIG. 4). The left and right regions 22 and 24, both preferably include two vertically extending cushions 54, and a horizontally extending, semi-circular cushion 55 (FIG. 4). As best shown in FIG. 5, the rear region 26 includes four vertically and horizontally spaced cushions 56.

As best shown in FIGS. 4–6, the shell 10 further includes a headband or strap 58, for properly and snugly securing the helmet H on a person's head. In particular, strap 58 includes left and right sections 60 and 62, which are fixedly attached at the front ends 64 and 66 to the shell 10 and extend rearwardly in corresponding recesses 68 and 70, respectively. The left and right sections 60 and 62 are joined in the rear region 26 of the shell 10 by a conventional buckle or fastener 72 (FIG. 2). The strap 58 allows the helmet H to be fitted to person's of various ages and head sizes.

Figure 3:
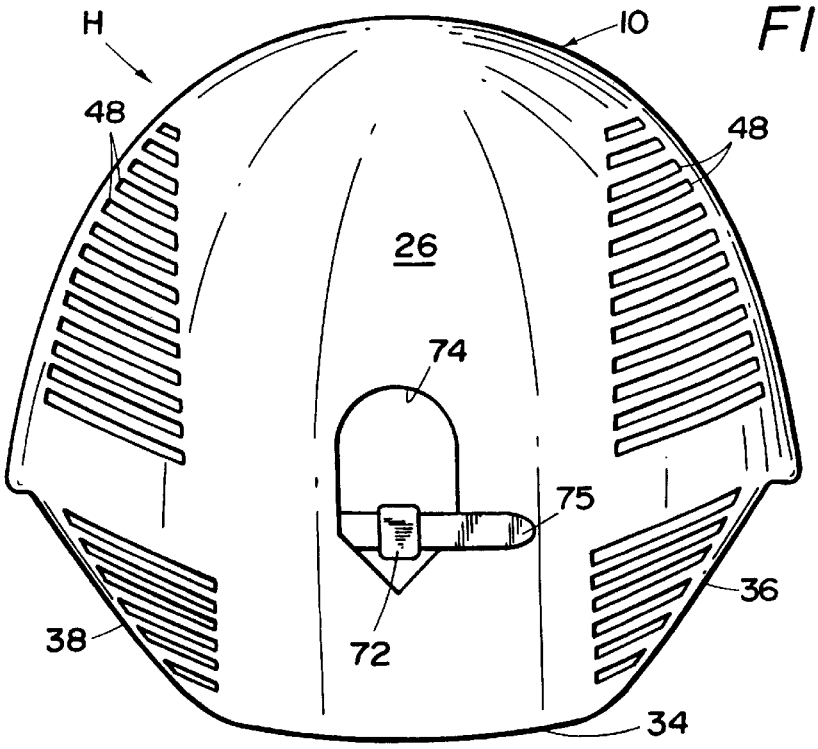
FIG. 3 is a rear elevational view of the protective helmet of the present invention.

As best shown in FIGS. 2–3, the rear region 26 includes a generally oval opening 74 to allow a person's ponytail or hair to extend therethrough. The opening 74 further accommodates buckle or fastener 72 and allows, if desired, the free end 75 of head band 58 to extend outwardly to thereby prevent any discomfort to the user.

Figure 7:
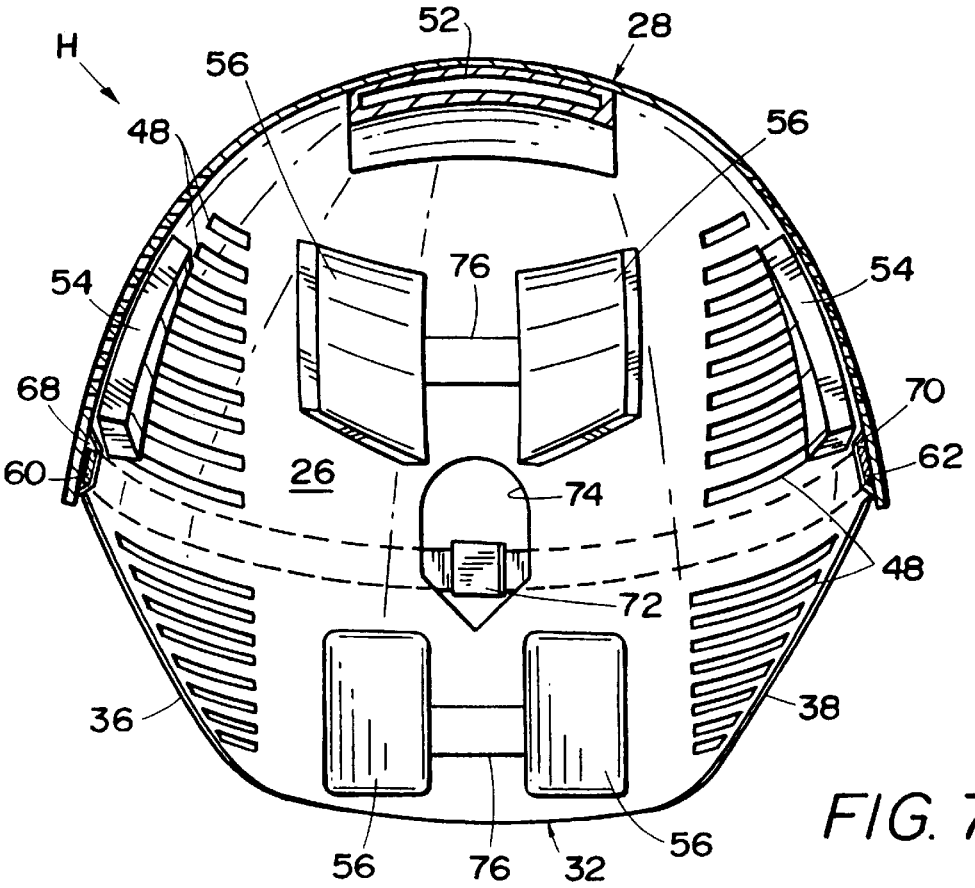
FIG. 7 is a view similar to FIG. 5 showing a first alternative embodiment of the protective helmet of the present invention.
Figure 8:
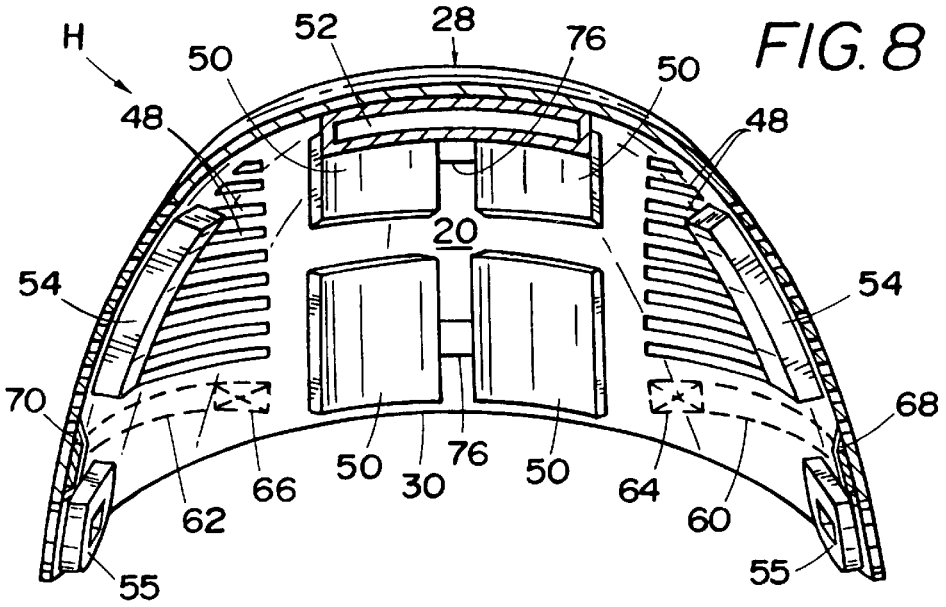
FIG. 8 is a view similar to FIG. 6 showing the first alternative embodiment of the protective helmet of the present invention.

FIGS. 7–8 illustrate a first alternative embodiment of the helmet H shown in FIGS. 1–6. In particular, the overall configuration and construction of the first alternative embodiment is the same as shown in FIGS. 1–6, with the exception that cushions are interconnected by air paths or tubes 76. (It is noted herewith that like parts are designated by the same numerals as in the embodiment shown in FIGS. 1–6.)

The provision of interconnecting the cushions facilitates dampening or dissipating the energy of impact over a zone which is larger than the surface area of an individual cushion. In particular, since the cushions are interconnected, a concussive wave would travel over a larger area than the overall surface area of one cushion, thereby distributing the energy of impact over a larger zone. This phenomenon therefore produces two results. First, the blow of impact is quickly dissipated, and second, the effect of the concussive wave is more evenly distributed. This results in minimized effect of an impact on the user's head.

It is noted herewith that although only the cushions in each region are shown to be interconnected, it is well within the scope of this invention to choose a different arrangement for interconnecting the cushions. For example, all (or fewer)

interconnected cushions in front region 20 may further be interconnected with the cushions in the left and/or right regions 22 and 24.

Figure 11:
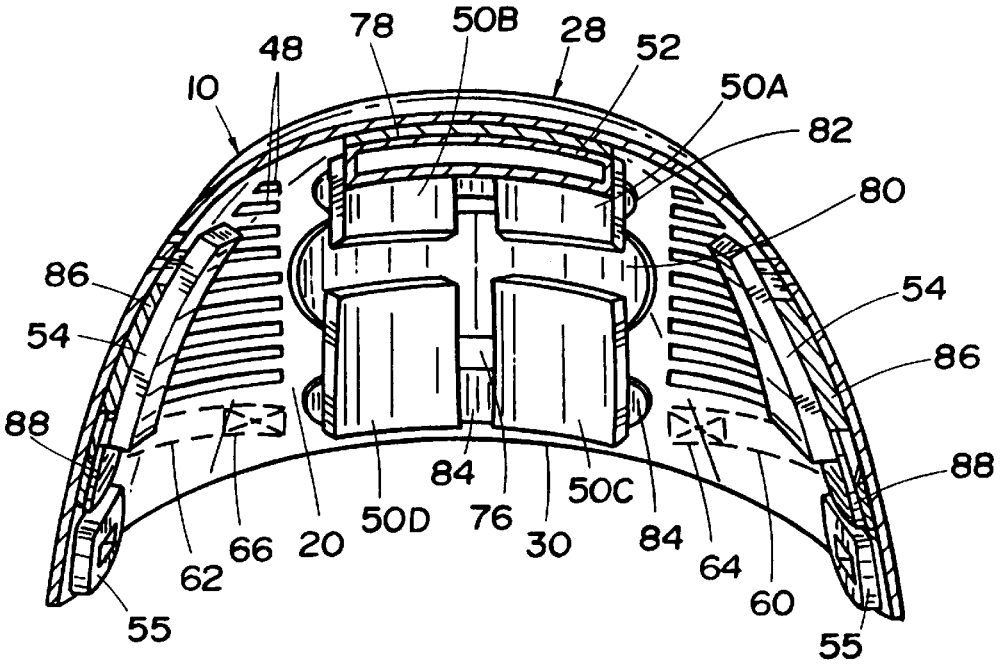
FIG. 11 is a vertical sectional view taken along line 11—11 of FIG. 9.

FIGS. 9–11 illustrate a second alternative embodiment of the helmet H. In particular, the second embodiment is similar to the embodiment shown in FIGS. 7–8, with the exception that semi-rigid or rigid impact dampening members are provided between the shell 10 and the cushions. The dampening members are preferably made of a plastic, foam, or the like material, and further facilitate in dampening or dissipating the impact energy over the helmet H. (It is noted herewith that like parts are designated by the same numerals as in the embodiment shown in FIGS. 1–6.)

While various forms and configurations of the dampening members can be used, it is preferable that the dampening member 78 provided between the shell 10 and top cushion 52 be slightly larger than the overall dimensions of the top cushion 52. Along the same lines, the front region 20 includes a generally oval-shaped central dampening member 80, and somewhat narrower in width top and bottom members 82 and 84, respectively.

As best shown in FIG. 11, central dampening member 80 partly overlaps all four cushions, while the upper dampening member 82 partly overlaps the two top cushions 50A and 50B, and the lower dampening member 84 partly overlaps the bottom two cushions 50C and 50D.

As best shown in FIG. 9, the left and right regions 22 and 24, each includes a generally rectangular upper impact dampening member 86, which partly overlaps the vertical cushions 54, and a generally oval impact member 88, which partly overlaps the side cushion 55 and the vertical cushion 54 towards the front of shell 10.

As best shown in FIG. 10, the rear region 26 includes upper and lower impact dampening members 90 and 92, which partly overlap the upper two rear cushions 56A and 56B. It should be noted that while the bottom two rear cushions 56C and 56D are not provided with any impact dampening member(s), it is well within the scope of the invention to do so. (It is noted herewith that an inner shell preferably made of a rigid or semi-rigid material and substantially corresponding to the outer shell 10, may be provided in place of individual dampening members, if desired.)

Figure 12:
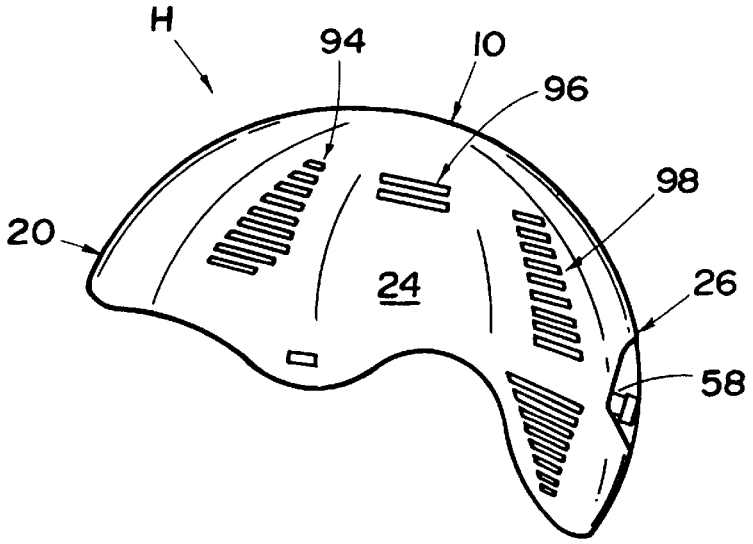
FIG. 12 is a side elevational view of a third alternative embodiment showing a different arrangement of the vent holes.

FIG. 12 illustrates a third alternative embodiment of the helmet H of the present invention, which is similar to the embodiments shown in FIGS. 1–11, with the exception of the arrangement of vent holes. In particular, the third embodiment includes three sets of vent holes 94, 96 and 98, on each of the left and right regions 22 and 24. As shown in FIG. 12, the right region 24 includes holes 94 disposed towards the front region 20, holes 98 disposed towards the rear region 26, and holes 96 disposed between the front and rear regions. A similar set of holes 94, 96 and 98 is provided on the left region 22.

The helmet H of the present invention can be used by a player to head-off a soccer ball using the front region 20 (or any of the other regions 22, 24, 26 and 28). While heading-off the ball, the cushions absorb and distribute the energy of impact over the helmet H. In the embodiment where the cushions are interconnected, the energy of impact is distributed throughout the area covered by the interconnected cushions. The energy of impact is further absorbed and distributed by the semi-rigid or rigid impact dampening members, which absorb the energy upon initial contact with a ball, goal-post, other player, etc., and then transfer the dampened energy to be further absorbed and distributed by the underlying cushions. In this manner, the risk of injury to a person's head is greatly reduced as the energy associated with the initial blow and the concussive wave is absorbed and distributed over a large region of the helmet.

It is further noted that since the helmet H of the present invention is made of a soft nylon, cloth, or the like material, as opposed to a hard material generally found in conventional helmets for football, bicycling, etc., the risk to other players from getting injured by players bumping into each other etc., is also greatly reduced. The softer shell further makes it easier to fit the helmet over different head sizes, in contrast to rigid helmets which are difficult to fit if the helmet size even slightly varies in relation to a person's head. In addition, the softer shell greatly facilitates printing of team logos, slogans, etc., thereon and can be easily made to match players' uniform. Finally, the softer shell is easier to maintain in that the cushions and the dampening members can be removed and the shell cleaned by the conventional household means.

While this invention has been described as having preferred embodiments, it is understood that it is capable of further modifications, uses and/or adaptations following in general the principle of the invention, and including such departures from the present disclosure as those come within the known or customary practice in the art to which the invention pertains, and as may be applied to the central features hereinsetforth and fall within the scope of the invention and the limits of the appended claims.

What I claim is:

1. A protective helmet for active use by a wearer in a sports activity, comprising;

a) a shell made of a soft material and having the general configuration of a wearer's head;

b) means for stabilizing said shell on the wearer's head operably connected to said shell;

c) means for actively deflecting a ball by the wearer;

d) said shell including front, rear, and left and right side portions;

e) said front portion substantially overlying the forehead of the wearer;

f) said ball deflecting means being located in said front portion;

g) said ball deflecting means comprising a plurality of laterally and vertically spaced individual cushions; and h) means for dampening the force of impact of the ball over a region of the wearer's head.

2. The protective helmet of claim 1, wherein:

a) said cushions comprising a hardness substantially corresponding to the hardness of a human forehead.

3. The protective helmet of claim 1, wherein:

at least one of said cushions comprises an inflatable cushion.

4. The protective helmet of claim 1, wherein:

a) said cushions comprise a plurality of interconnected cushions.

5. The protective helmet of claim 4, wherein:

a) said cushions are inflatable.

6. The protective helmet of claim 4, wherein:

a) at least two of said cushions are interconnected by at least one air path.

7. The protective helmet of claim 3, wherein:

a) said inflatable cushion is removably secured to said shell.

8. The protective helmet of claim 1, wherein:

a) said shell includes an outside and an inside; and b) said ball deflecting means is located on the inside of said shell.

9. The protective helmet of claim 8, wherein:

a) said impact dampening means includes at least one dampening member disposed between said shell and said ball deflecting means.

10. The protective helmet of claim 1, wherein;

a) said shell includes venting means.

11. The protective helmet of claim 10, wherein:

a) said venting means comprises a plurality of venting holes.

12. The protective helmet of claim 11, wherein:

a) one of said venting holes is generally rectangular in shape.

13. The protective helmet of claim 11, wherein:

a) said venting holes are generally rectangular in shape.

14. The protective helmet of claim 13, wherein:

a) said venting holes are vertically spaced from each other.

15. The protective helmet of claim 1, wherein:

a) said shell includes venting means;

b) said venting means comprises a plurality of generally rectangular venting holes;

c) said venting holes comprise first and second groups of vertically spaced venting holes;

d) said front portion comprises a central region and left and right front subregions; and e) said first and second groups of venting holes are positioned on said left and right front subregions, respectively.

16. The protective helmet of claim 15, wherein:

a) said individual cushions are located in said central region.

17. A protective helmet for active use by a wearer in a sports activity, comprising:

a) a shell made of a soft material and having the general configuration of a wearer's head;

b) a strap member for stabilizing said shell on the wearer's head operably connected to said shell;

c) said shell including front, rear and left and right regions;

d) a ball deflecting member located about said front region;

e) said ball deflecting member comprising a plurality of laterally and vertically spaced individual cushions; and f) an impact dampening member for dampening the force of impact by a ball over a region of the wearer's head;

g) whereby said helmet can be used by the wearer to deflect a ball by making an active contact with the ball.

18. The protective helmet of claim 17, wherein;

a) said cushions comprise a plurality of interconnected cushions.

19. The protective helmet of claim 17, wherein:

a) said shell includes an inside and an outside; and b) said ball deflecting member is disposed on the inside of said shell.

20. The protective helmet of claim 19, wherein;

a) said impact dampening member is disposed between said shell and said ball deflecting member.

* * * * *